US007950983B2

(12) United States Patent
Huang et al.

(10) Patent No.: US 7,950,983 B2
(45) Date of Patent: May 31, 2011

(54) RETAINER RING

(75) Inventors: Soon Kang Huang, Hsin-Chu (TW); Chih-Lung Lin, Taipei (TW); Chyi-Shyuan Chern, Taipei (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 0 days.

(21) Appl. No.: 12/683,033

(22) Filed: Jan. 6, 2010

(65) Prior Publication Data

US 2010/0112912 A1 May 6, 2010

Related U.S. Application Data

(63) Continuation of application No. 11/751,468, filed on May 21, 2007, now Pat. No. 7,666,068.

(51) Int. Cl.
*B24B 1/00* (2006.01)

(52) U.S. Cl. ..... 451/36; 451/41; 451/59; 451/60

(58) Field of Classification Search ..... 451/36, 451/41, 59, 60, 285, 286, 287, 288, 289, 451/290, 398, 446, 63
See application file for complete search history.

(56) References Cited

U.S. PATENT DOCUMENTS

| | | | |
|---|---|---|---|
| 6,293,850 | B1 | 9/2001 | Lin et al. |
| 6,336,846 | B1 | 1/2002 | Park et al. |
| 6,336,850 | B1 | 1/2002 | Wada et al. |
| 6,454,637 | B1 | 9/2002 | Gotkis |
| 6,527,624 | B1 | 3/2003 | Tolles et al. |
| 7,214,123 | B2 | 5/2007 | Han |
| 7,347,767 | B2 | 3/2008 | Chandrasekaran |

FOREIGN PATENT DOCUMENTS

| | | |
|---|---|---|
| JP | 2007-290085 | 11/2007 |

*Primary Examiner* — Timothy V Eley
(74) *Attorney, Agent, or Firm* — Slater & Matsil, L.L.P.

(57) ABSTRACT

A retainer ring and a method of using the retainer ring are provided. The retainer ring has openings along a bottom surface. Grooves encompass the openings and extend to an interior portion of the retainer ring wherein a semiconductor wafer may be held. In operation, a semiconductor wafer is placed inside the retainer ring. As the retainer ring and the semiconductor wafer are moved relative to an underlying polishing pad, slurry is dispensed through the openings in the retainer ring. The grooves in the retainer ring allow the slurry to flow from the openings to the interior portion of the retainer ring and the semiconductor wafer.

17 Claims, 4 Drawing Sheets

RETAINER RING

This application is a continuation of U.S. patent application Ser. No. 11/751,468, entitled "Retainer Ring," filed on May 21, 2007, which application is incorporated herein by reference.

TECHNICAL FIELD

The present invention relates generally to semiconductor devices and, more particularly, to a retainer ring that may be used to manufacture semiconductor devices.

BACKGROUND

Generally, semiconductor devices comprise electronic components, such as transistors, capacitors, or the like, formed on a substrate. One or more metal layers are then formed over the electronic components to provide connections between the electronic components and to provide connections to external devices. The metal layers typically comprise an intermetal dielectric layer in which vias and interconnects are formed, usually with a single- or dual-damascene process.

During the fabrication process, it may be necessary or desirable to perform one or more planarization processes. For example, transistors and other devices may be formed on a substrate such that the topology is not planar. Because of this non-planar topology an intermetal dielectric layer deposited over the transistors and other devices also exhibit a non-planar topology. However, it is desirable to form a subsequent metal layer on a planar surface, and as a result, it is desirable to planarize the intermetal dielectric layer in preparation of forming a metal layer.

One method of planarizing a surface is by chemical mechanical polishing (CMP). Generally, CMP involves placing a wafer in a retainer ring. The retainer ring and the wafer are rotated as pressure is applied to the wafer against a polishing pad. A chemical solution, referred to as a slurry, is deposited onto the surface of the polishing pad to aid in the planarizing.

Optimally, the slurry is applied uniformly over the surface of the polishing pad at a location at which the wafer is to contact the polishing pad. If the slurry is not applied uniformly, the wafer may be polished unevenly across the wafer.

Accordingly, an apparatus for and method of applying a slurry uniformly and efficiently is needed.

SUMMARY OF THE INVENTION

These and other problems are generally reduced, solved or circumvented, and technical advantages are generally achieved, by embodiments of the present invention, which provides a retainer ring that may be used in manufacturing semiconductors.

In an embodiment of the present invention, a retainer ring is provided. The retainer ring comprises a circular ring having grooves formed in a first major surface. The grooves extend through an inner edge of the circular ring. The retainer ring further comprises a plurality of openings, such that each of the grooves has one of the plurality of openings.

In another embodiment of the present invention, a retainer ring is provided. The retainer ring comprises a circular ring having an inner edge and a concentric outer edge. The circular ring has a plurality of openings extending therethrough. The circular ring also has a plurality of grooves, each groove encompassing an opening and extending through to the inner edge of the circular ring.

In yet another embodiment of the present invention, a CMP device is provided. The CMP device comprises a rotating platen, a rotating carrier, and a retainer ring. The rotating platen is configured to accept and rotate a polishing pad. The rotating carrier is configured to accept a semiconductor wafer and to couple to the retainer ring. The retainer ring has an inner edge and an outer edge with a plurality of grooves extending from the inner edge toward the outer edge. Each groove has an opening extending through the retainer ring and configured to dispense a slurry.

It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

The object and other advantages of this invention are best described in the preferred embodiment with reference to the attached drawings that include.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Figure 1:
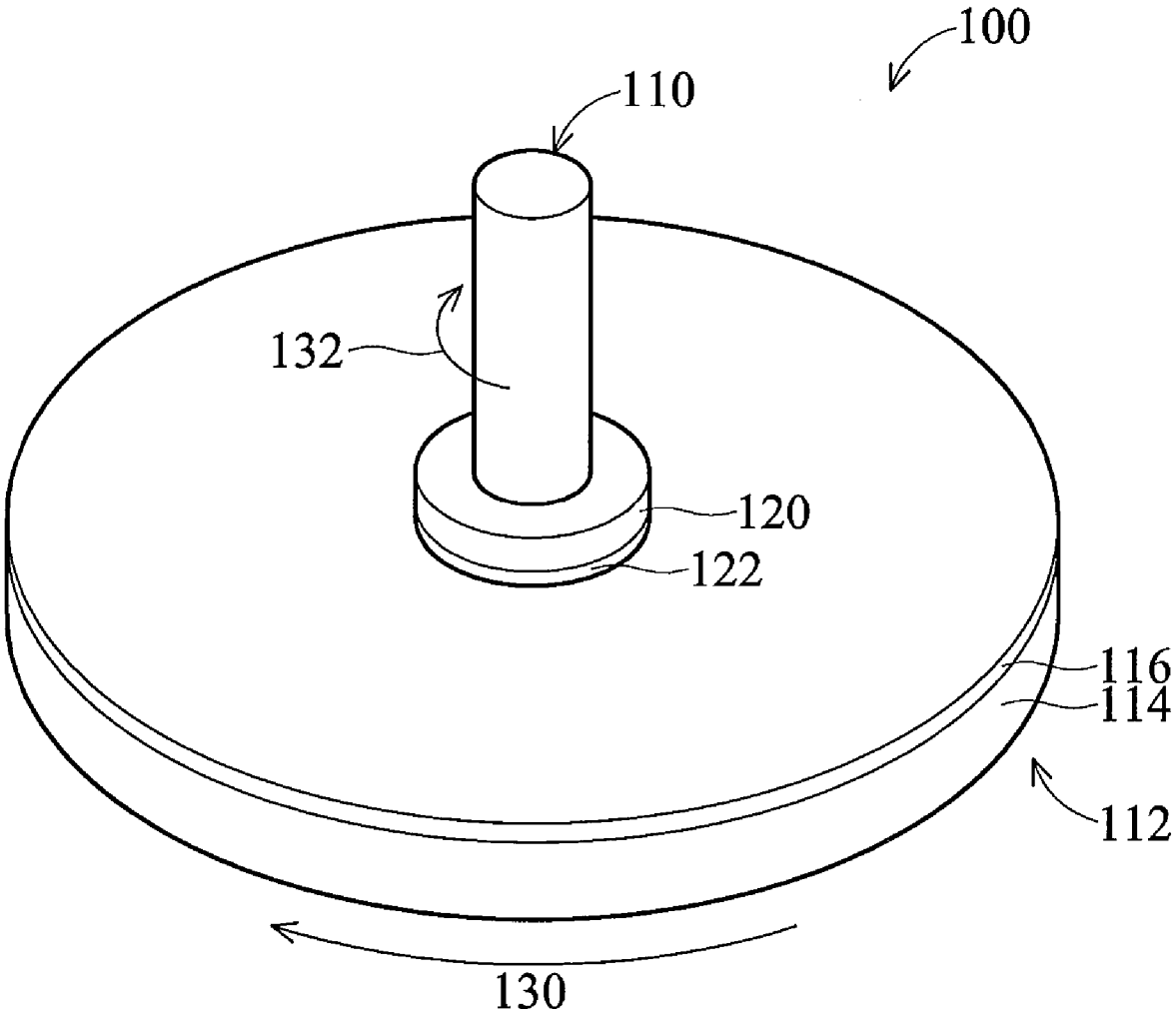
FIG. 1 is a perspective view of a polishing station in accordance with an embodiment of the present invention.

FIG. 1 illustrates a portion of a polisher station 100 in accordance with an embodiment of the present invention. Generally, the polisher station 100, which may be used in a CMP process, includes a rotating carrier 110 positioned above a rotating platen 112. The rotating platen 112 includes a rotating table 114 with a polishing pad 116 mounted thereto on a top surface of the rotating table 114 such that the polishing pad 116 rotates with the rotating table 114. The rotating carrier 110 includes a rotating carrier head 120 and a retainer ring 122. The rotating carrier head 120 and retainer ring 122 hold an item to be polished, e.g., a semiconductor wafer, in position (see FIGS. 2-3). A vacuum (not shown) may also be used to aid in holding the semiconductor wafer in position.

In operation, the rotating platen 112 rotates as indicated by arrow 130 while the rotating carrier head 120 rotates as indicated by arrow 132. Downward pressure is applied to the semiconductor wafer, held in place by the rotating carrier head 120, to cause the semiconductor wafer to contact the polishing pad 116. The downward pressure is maintained as the rotating platen 112 and the rotating carrier head 120 rotate.

As will be described in greater detail below, a slurry (not shown) is deposited through slots in the retainer ring 122. In this manner, the slurry is deposited directly in the vicinity in which it is needed, thereby reducing waste and increasing the uniformity of the dispersion.

Figure 2:
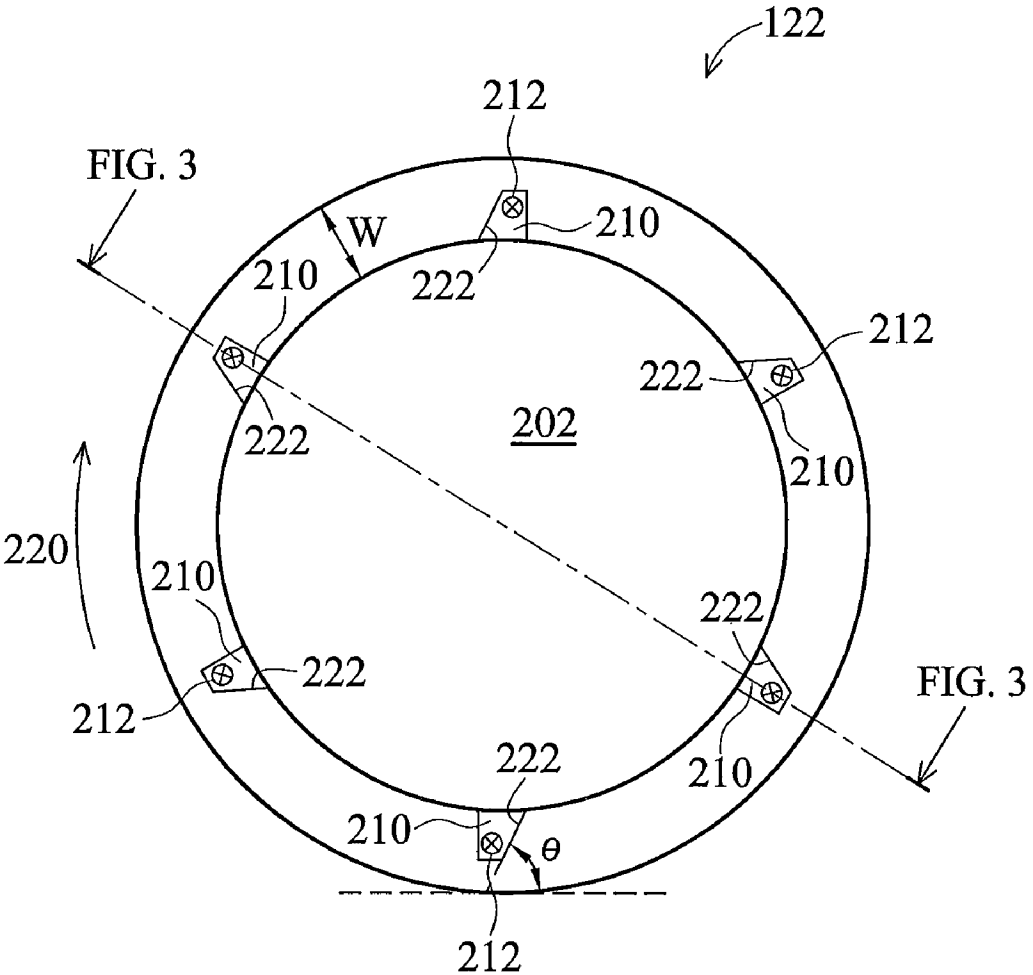
FIG. 2 is a bottom view of a retainer ring in accordance with an embodiment of the present invention.
Figure 3:
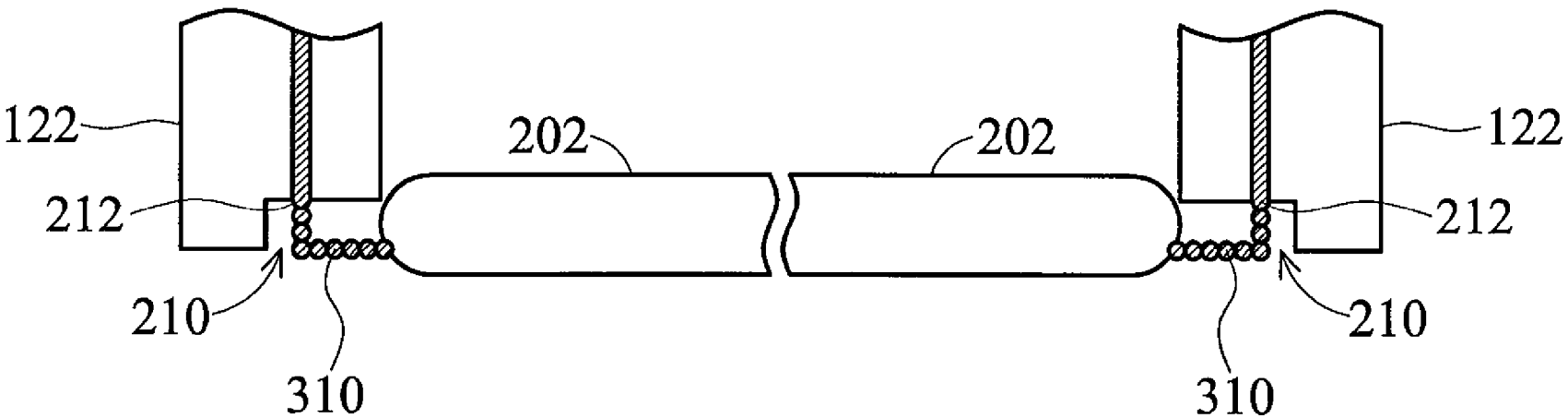
FIG. 3 is a side view of a retainer ring in accordance with an embodiment of the present invention.

FIGS. 2 and 3 illustrate a bottom view and a side view, respectively, of the retainer ring 122 in accordance with an embodiment of the present invention. The retainer ring 122 is a generally circular ring with a hollow center, e.g., a donut shape. A semiconductor wafer 202 to be polished is positioned in the center of the circular ring such that the retainer ring 122 can aid in maintaining the semiconductor wafer 202 in position.

In an embodiment, the retainer ring 122 has a substantially uniform width W and has one or more grooves 210 formed along the bottom surface, e.g., the surface. Within grooves 210 is an opening 212 through which a slurry may be dispensed. In a preferred embodiment, the grooves 210 do not extend completely over the retainer ring 122, but rather extend from a position around the opening 212 through which the slurry is to be dispensed to the interior region. Accordingly, as the slurry is dispensed through the opening 212, the grooves 210 allow the slurry to flow easily and directly to the semiconductor wafer 202.

Preferably, the size and shape of the grooves 210 are designed such that the shape and size together with the rotation of the rotating carrier head 120, and hence the retainer ring 122, force the slurry dispensed through the openings 212 into the interior region of the retainer ring 122. For example, one of ordinary skill in the art will appreciate that the shape of the grooves 210 illustrated in FIG. 2 aids in forcing the slurry into the interior region of the retainer ring 122. In particular, as the slurry is dispensed from the opening 212, the rotation of the retainer ring 122 along the direction indicated by arrow 220 will force the slurry against a slanted groove sidewall 222. As a result, the slant and rotation will force the slurry to progress along the slanted groove sidewall 222 into the interior region of the retainer ring 122 where the semiconductor wafer 202 is positioned.

In an embodiment, the grooves 210 have a depth from about 1 mm to about 3 mm, and the slant of the slanted groove sidewall has an angle θ, relative to the tangent of the retainer ring 122 that is about 30° to about 150°. In an embodiment, the openings 212 have a diameter from about ¼" to about ½".

FIG. 3 illustrates a sideview of the retainer ring 122 along the line indicated in FIG. 2 and further illustrates the flow of slurry 310 through the retainer ring 122 in accordance with an embodiment of the present invention. As illustrated in FIG. 3, the grooves 210 preferably extend partially through the retainer ring 122 such that the grooves 210 extend from the openings 212 to the interior portion of the retainer ring 122 where the semiconductor wafer 202 is located. The slurry 310 is dispensed through the retainer ring directly into the grooves 210. The grooves 210 extend from the opening 212 to the interior portion of the retainer ring 122, thereby allowing the slurry to flow directly onto the polishing pad near the semiconductor wafer 202.

It should be noted that FIG. 2 illustrates the retainer ring 122 having six grooves 210 for illustrative purposes only. Accordingly, embodiments of the present invention may have a fewer or greater number of grooves. Furthermore, the shape of the groove and orientation of the groove may be adjusted to better suit a particular application. For example, in applications in which the rotation speed is high, a groove with a smaller slant may be desirable, whereas applications in which the rotation speed is lower a groove with a greater slant may be desirable to aid the movement of the slurry toward the interior portion of the retainer ring. Other features, such as the width of the retainer ring, depth of the grooves, the length of the grooves, and the like, may also be modified in accordance with embodiments of the present invention.

Figure 4:
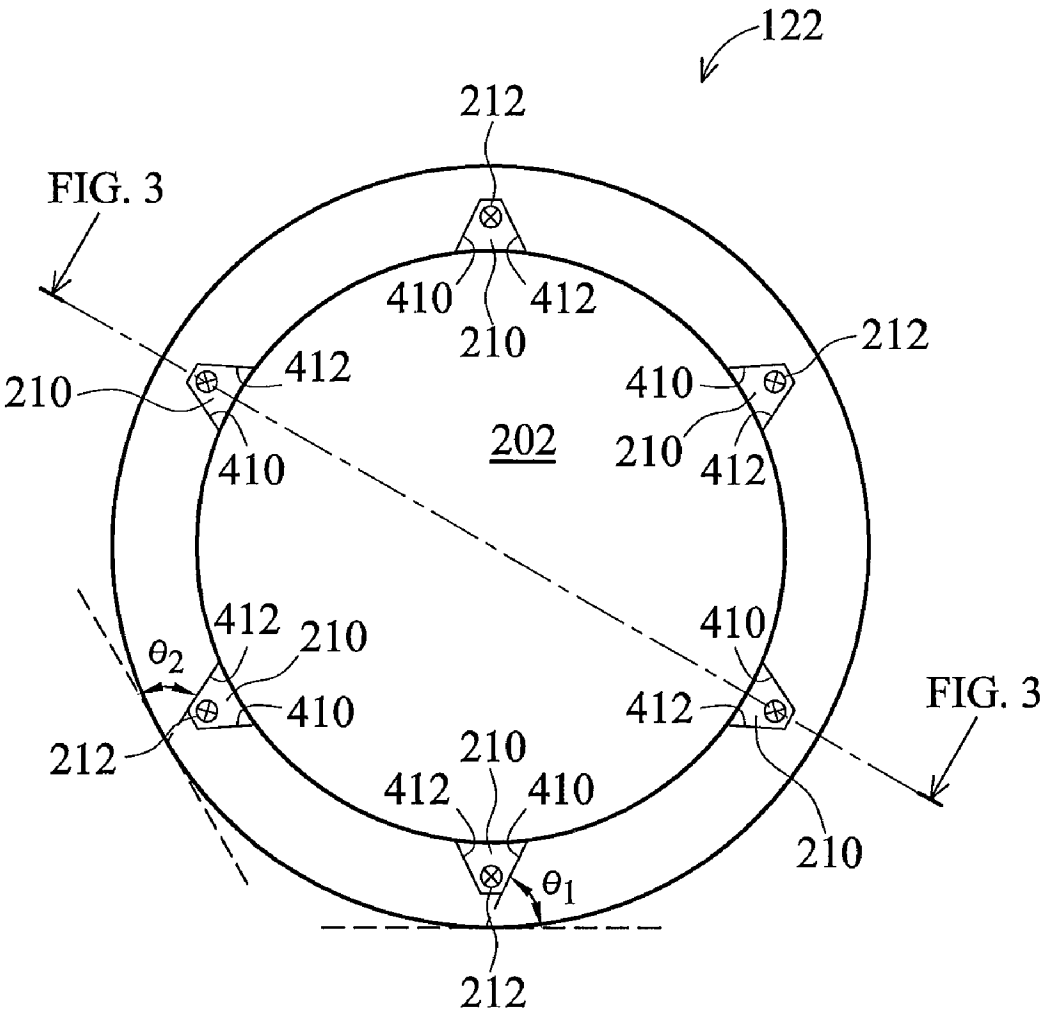
FIG. 4 is a bottom view of another retainer ring in accordance with an embodiment of the present invention.

FIG. 4 illustrates a retainer ring 122 in accordance with another embodiment of the present invention. The retainer ring 122 of FIG. 4 is similar to the retainer ring 122 of FIG. 2 wherein like reference numerals refer to like elements. One of ordinary skill in the art will realize that each of the grooves 210 have a first slanted sidewall 410 and a second slanted sidewall 412 rather than a single slanted sidewall 222 as illustrated in the embodiment of FIG. 2. Having two slanted sidewalls may aid in the even distribution of slurry in some situations.

It should be noted that the first and second slanted sidewalls 410 and 412 may have equivalent offset angles $\theta_1$ and $\theta_2$, respectively, or the first and second sidewalls 410 and 412 may have different offset angles $\theta_1$ and $\theta_2$.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method of polishing a semiconductor wafer, the method comprising:

providing the semiconductor wafer;

placing the semiconductor wafer in a rotating carrier, the rotating carrier having a retainer ring having an inner edge and an outer edge coupled thereto, the retainer ring having a plurality of openings along a bottom surface and each opening having a groove with non-parallel sidewalls extending from the respective opening to an inner edge of the retainer ring, wherein the sidewalls of each groove continuously angle away in opposite directions from a shortest line extending from the respective opening to the inner edge; and rotating the semiconductor wafer as a slurry is dispensed through the openings.

2. The method of claim 1, wherein each groove does not extend through the outer edge.

3. The method of claim 1, wherein each groove has a depth of about 1 mm to about 3 mm.

4. The method of claim 1, wherein each opening has a diameter of about ¼" to about ½".

5. The method of claim 1, wherein at least one of the sidewalls has an angle of about 30° to about 150° relative to a tangent of the outer edge of the retainer ring.

6. The method of claim 1, wherein the retainer ring has a substantially uniform width.

7. A method of polishing a semiconductor wafer, the method comprising:

providing the semiconductor wafer;

placing the semiconductor wafer in an interior area of a retainer ring, the retainer ring having a plurality of grooves extending through an inner edge of the retainer ring, at least one groove having an opening, said at least one groove having a first sidewall parallel to and a second sidewall slanted away from a shortest line drawn from the respective opening to the inner edge;

placing a polishing pad opposing the semiconductor wafer;

applying pressure so as to force the semiconductor wafer toward the polishing pad; and moving the retainer ring and the semiconductor wafer with respect to the polishing pad as a slurry is dispensed through the at least one opening.

8. The method of claim 7, wherein each groove does not extend through an outer edge.

9. The method of claim 8, wherein the retainer ring has a substantially uniform width.

10. The method of claim 7, wherein each groove has a depth of about 1 mm to about 3 mm.

11. The method of claim 7, wherein each opening has a diameter of about ¼" to about ½".

12. The method of claim 7, wherein the second sidewall has an angle of about 30° to about 150° relative to a tangent of an outer edge of the retainer ring.

13. A method of applying a slurry during a polishing process, the method comprising:

providing a retainer ring having a plurality of grooves, at least one of the grooves having an opening therein, said at least one groove having non-parallel sidewalls slanted in opposing directions relative to a shortest line extending from the opening to an inner edge;

placing a semiconductor wafer in an interior area of the retainer ring;

placing a polishing pad opposing the semiconductor wafer;

applying pressure so as to force the semiconductor wafer toward the polishing pad; and moving the retainer ring and the semiconductor wafer with respect to the polishing pad as a slurry is dispensed through the at least one opening.

14. The method of claim 13, wherein each groove does not extend through an outer edge.

15. The method of claim 13, wherein each groove has a depth of about 1 mm to about 3 mm.

16. The method of claim 13, wherein each opening has a diameter of about ¼" to about ½".

17. The method of claim 13, wherein at least one of the sidewalls has an angle of about 30° to about 150° relative to a tangent of an outer edge of the retainer ring.

* * * * *